United States Patent [19]

Davies

[11] 3,950,746

[45] Apr. 13, 1976

[54] ELECTRICALLY ENERGIZED FIRE AND/OR INTRUSION DETECTION SYSTEM INCLUDING SPRING-BIASED SWITCHING MEANS

[76] Inventor: John S. Davies, 1010 Norumbega, Monrovia, Calif. 91016

[22] Filed: Sept. 17, 1970

[21] Appl. No.: 72,976

[52] U.S. Cl...... 340/420; 200/61.93; 340/227 C; 340/276

[51] Int. Cl.[2]..... G08B 13/12

[58] Field of Search..... 340/227, 227 C, 227.1, 340/232, 420; 200/61.93

[56] References Cited

UNITED STATES PATENTS

| | | | |
|---|---|---|---|
| 793,775 | 7/1905 | Esser | 340/232 X |
| 1,699,663 | 1/1929 | Hess | 200/61.93 X |
| 3,257,530 | 6/1966 | Davies | 340/227 C |
| 3,537,093 | 10/1970 | Perret | 340/420 X |
| 3,550,120 | 12/1970 | Kompelien | 340/409 |

*Primary Examiner*—David L. Trafton
*Attorney, Agent, or Firm*—Keith D. Beecher

[57] ABSTRACT

An electrically energized fire and/or intrusion detection system is provided which includes an elongated electrically energized heat sensing element, and which also includes a plurality of spring-biased switching devices mechanically coupled to the heat sensing element to respond to tension variations therein to provide predetermined control effects, such as initiating alarms and/or activating appropriate fire suppression devices.

6 Claims, 9 Drawing Figures

INVENTOR
John S. Davies
Jenny and Becker
By Keith D. Becker
ATTORNEYS

INVENTOR:
John S. Davies
Jenny and Becker
By Keith D. Becker
ATTORNEYS

INVENTOR
John S. Davies
Kemp and Beecher
By Keith A. Beecher,
ATTORNEYS

INVENTOR:
John S. Davies
Stump and Bucher
By Keith D. Bucher
ATTORNEYS

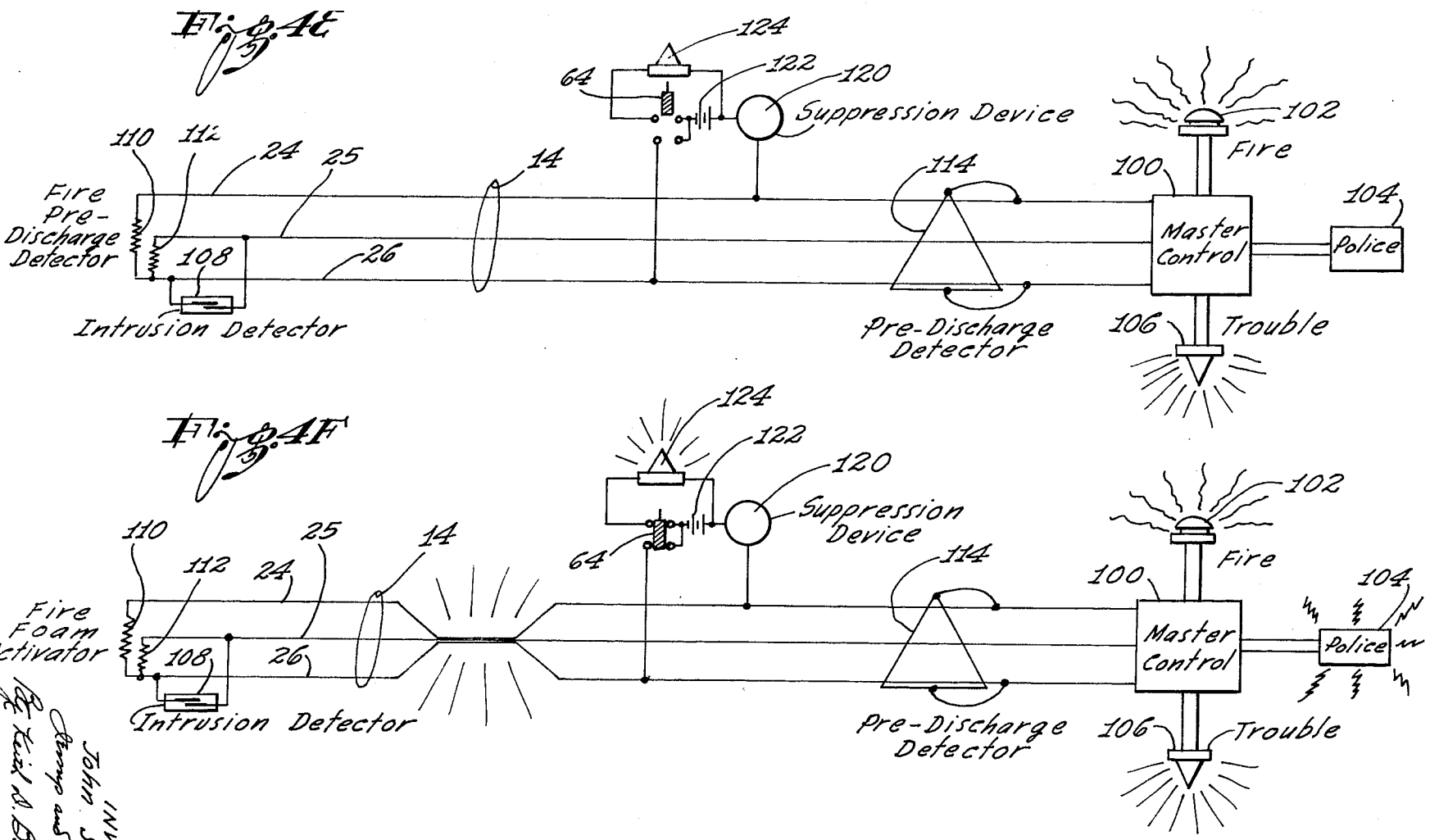
INVENTOR
John S. Davies
Stump and Beecher
By Keith D. Beecher
ATTORNEYS

ELECTRICALLY ENERGIZED FIRE AND/OR INTRUSION DETECTION SYSTEM INCLUDING SPRING-BIASED SWITCHING MEANS

BACKGROUND OF THE INVENTION

The detection system of the invention includes, for example, an elongated electrically energized heat sensing element of the type described in U.S. Pat. No. 3,257,530 which issued June 21, 1966, and which element may be extended through the facility to be protected. The system may also include a multiplicity of spot detector units such as described in Copending application Ser. No. 735,006 filed June 6, 1968, in the name of the present inventor (now abandoned), and which units are spaced along the electrically energized heat sensing element at critical points in the area to be protected.

The detection system described in U.S. Pat. No. 3,257,530, and in the copending application referred to above, includes an elongated heat sensing element which is mounted under tension in the area to be protected such as, for example, a home, warehouse, supermarket, coal mine, or the like, or any combination thereof. One embodiment of the heat sensing element, as will be described, comprises two or three electric wires separated from one another by a suitable insulation to form a cable, the cable being twisted and held under tension in its twisted condition. The cable insulation is sufficiently softened when a particular temperature threshold is exceeded, so that the wires may twist together into electrical contact to complete an electric circuit and activate appropriate alarm control mechanisms and fire extinguishing apparatus.

The system described in the copending application comprises a multiplicity of spot detector units which are connected at critical points to the wires of the elongated heat sensing cable element. These spot detector units respond instantaneously to abnormal rises in temperature at the critical points, so as to create the desired alarm and/or control effect even before the insulation between the wires in the tensioned heat sensing element is sufficiently softened to permit the wires themselves to come together and initiate the control.

The system of the present invention in the embodiment to be described incorporates one or more tension arms which respond to a break or a slackening of the tensioned heat sensing cable element to actuate a local electrical control circuit, so that appropriate alarms or other control effects may be initiated, as will be described.

BRIEF DESCRIPTION OF THE DRAWINGS

FIGS. 4A–4F are schematic circuit diagrams showing various conditions which are monitored and detected by the system of the invention, and the various control effects produced by the system in response to the happening of the various conditions.

DETAILED DESCRIPTION OF THE ILLUSTRATED EMBODIMENT

It will be appreciated that many different types of mounting elements may be used for the heat sensing cable element of the present invention, it merely being required that the cable be maintained in a tensioned and twisted condition, and be positioned about the area to be monitored. The installation of FIG. 1 is intended to show merely one typical installation for the system.

Figure 1:
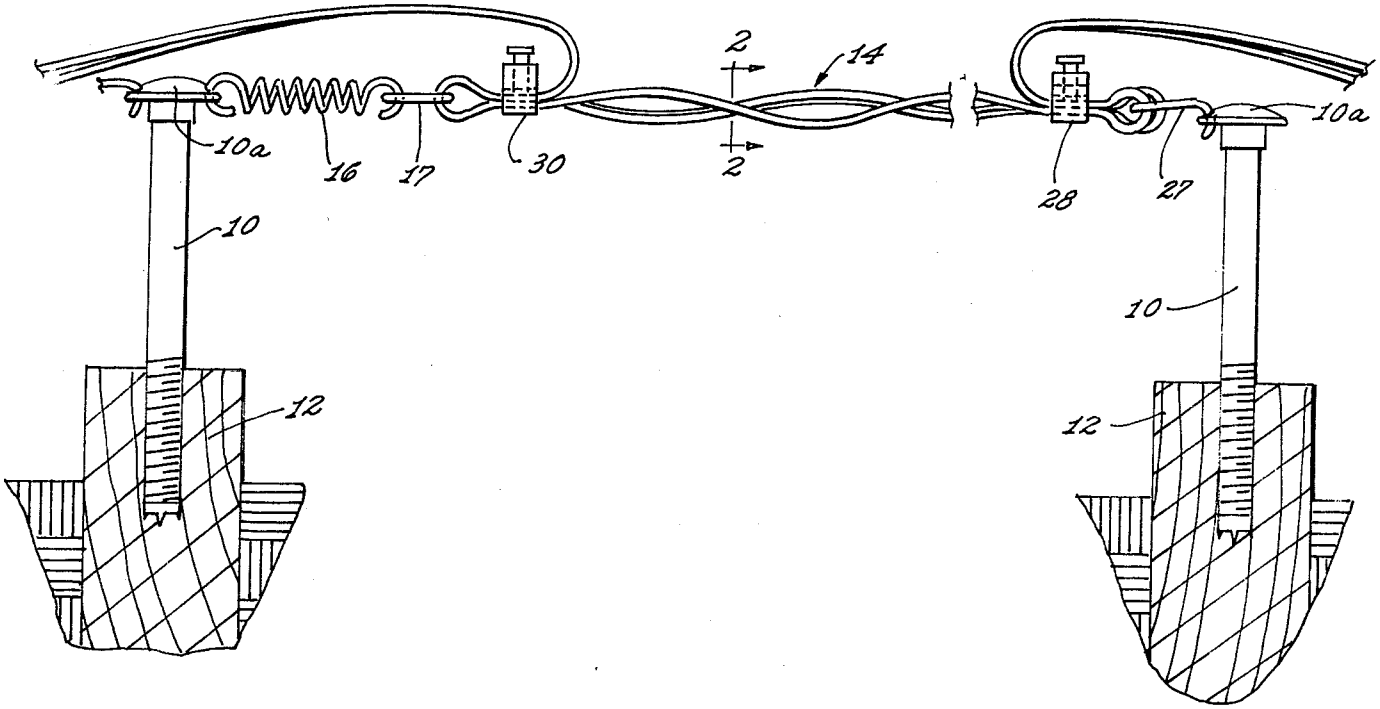
FIG. 1 is a somewhat schematic representation showing the manner in which the aforesaid heat sensing cable element is mounted and tensioned, as described in the U.S. Pat. No,. 3,257,530.

The installation shown in FIG. 1 includes, for example, a plurality of support posts 10 which may be mounted on any appropriate pedestals such as blocks 12, or which may, if desired, be supported by the ceiling, floor, wall, joists or the like in the area being protected. The purpose of the posts 10 is to provide a rigid support for the twisted and tensioned heat sensing cable element 14. The head 10a of each support post is apertured, and the heat sensing cable is twisted and is supported under tension between the posts. The tensioning is achieved, for example, by means of a coil spring 16 which has one end extending through an aperture in the head 10a of the left-hand post 10, and has its other end coupled to the end of the cable 14 through a clip 17.

Figure 2:
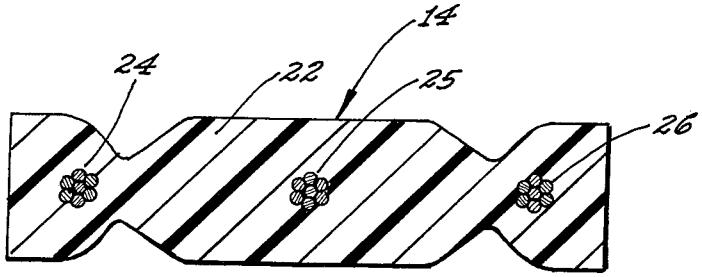
FIG. 2 is an enlarged cross-section of the heat sensing cable, taken along the line 2-2, and showing the three separate electrical wires which are supported within appropriate insulation within the cable.

The heat sensing cable 14 may have the form shown in FIG. 2, and it includes a flat elongated strip 22 of a flexible plastic insulating material, and three flexible multi-strand electrical wire conductors 24, 25 and 26 extending through the strip, and normally separated from one another by the insulating material of the strip. In the installation of FIG. 1, one end of the cable 14 is looped through a clip 27 and clamped by means of a clamp 28. The clip 27 is supported in the aperture in the head 10a at the right-hand support post 10. The other end of the cable 14 is looped through the clip 17 and clamped by a clamp 30. The cable 14 is supported between the support posts 10 in a twisted configuration and under tension by the spring 16. The clip 27, for example, has a bifurcated configuration, and it extends through two holes in the head 10a to prevent the cable 14 from turning and to hold it in its twisted configuration, as described in the aforesaid patent.

As mentioned above, the installation of FIG. 1 is shown merely by way of example, since many different types of installations may be used to maintain the heat sensing cable 14 in its twisted tensioned state. It will be appreciated that under normal conditions, the wire conductors 24, 25 and 26 in the cable 14 are held in a spaced, mutually insulated relationship. However, the insulating material forming the strip 22 is composed of a selected plastic material which, as described in the aforesaid patent, will melt in the presence of fire, or excessive heat. Such melting of the insulating material causes the wire conductors 24, 25 and 26 to spin together into a closed mutual electrical contact so as to complete appropriate electric circuits, as will be described in conjunction with FIGS. 4A-4F.

Figure 3:
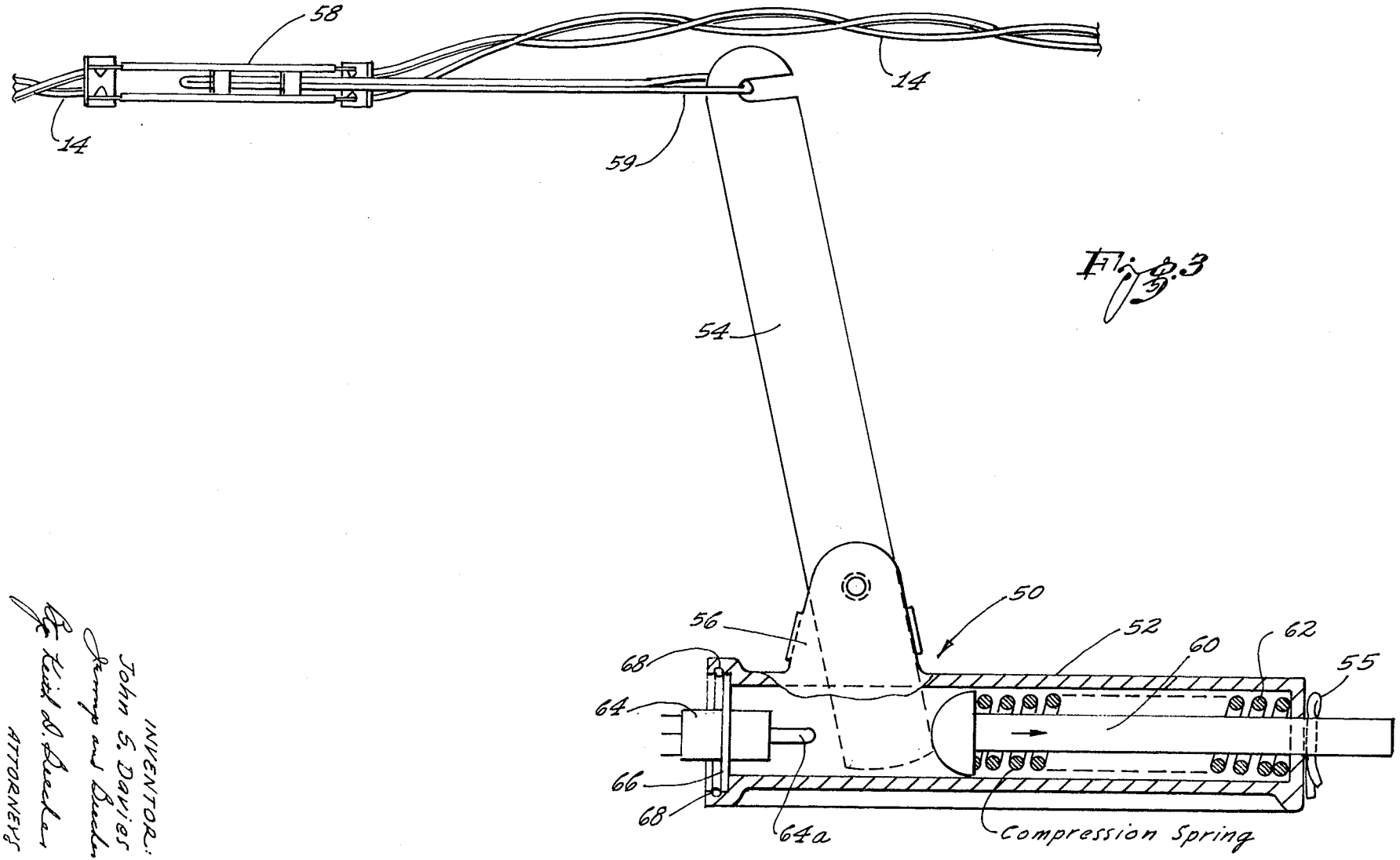
FIG. 3 is a side elevation, partly in section, showing the spring tension arm which may be incorporated into the fire detection system in accordance with the concepts of the present invention.

The spring 16 of FIG. 1 may be replaced by the tension arm designated 50 in FIG. 3, or the tension arm may be coupled to the clip 17, for example, and used in conjunction with the spring 16. As shown in FIG. 3 the tension arm assembly includes a housing 52 which may be mounted on the ceiling of the structure, or on any other appropriate surface, by any appropriate means (not shown). The housing 52 of the tension arm assembly, may be provided with mounting holes in the base of the housing, to facilitate attachment to ceiling, roofs, walls, posts, etc. Further, due to the design of this device, it may be mounted in any position — upward, downward, sideways, or any way.

The mechanism of FIG. 3 also includes an arm 54 which is pivotally mounted on a support yoke 56 on the housing 52. The free end of the arm 54 is coupled to the cable 14 by means, for example, of an appropriate clamp assembly 58. The clamp assembly has a looped member 59 which extends through an appropriate opening in the end of the arm 54. The arm 54 is biased in a clockwise direction by means, for example, of a spring loaded pin 60 in the housing 52, the pin 60 being biased to the left in FIG. 3 by means of a compression spring 62. The head of the pin 60 engages the lower end of the arm 54, and thereby urges the arm 54 in a clockwise direction about its pivot axis in the yoke 56.

As long as sufficient tension is maintained in the cable 14, the actuating arm 54 is held in the forward, tilted, or straight up, position. However, should the tension in the cable 14 decrease due, for example, to a cutting of the cable, or to a softening of the insulation due to fire conditions, or the like, the arm 54 moves in a backward direction so that its lower end engages a switch 64 mounted in the left-hand end of the housing 52.

The switch 64 may be a usual multi-contact, push-button switch, and it may include a plunger 64a. The switch is constructed, preferably, so that when the plunger 64a is moved a predetermined distance into the switch housing, a first set of contacts closes, and then when the plunger is moved fully into the housing, a second set of contacts closes. This enables an initial alarm to be established when the first set of contacts closes, and a second alarm and control effect to be initiated when the second set of contacts closes indicating a full relaxation of the tension of the cable 14. The switch 64 may be mounted in the end of the housing 52, as shown, in an appropriate disc-like plate 66 which may be held in place, for example, by means of a lock spring 68. Other equivalent switching means may be used which is actuated by the aforesaid movement of the lever arm 54.

The tension arm lever 54 is so designed that, by insertion of a lock-pin or cotter key 55 into a hole in the shaft of the spring compression rod 60, the spring 62 is held under maximum compression so that the tension arm lever 54 is free to move in a full backward and forward position, for ease of installation, or for interchanging the lever.

After the cable 14 has been inserted into the cable clamp 58 with the bail 59 located into the slot in the upper portion of the tension lever arm 54, the cable 14 can be pulled taut by hand through the clamp 58, with the lever 54 in a fully forward position with no force behind it. With the wedge secured in the cable clamp 58, a slight pressure of the hand upon the wire 14 or the lever 54, the lever can be pulled forward, pressing against the head of the compression pin 60, permitting the lock-pin to be withdrawn so that the spring 62 now forces the compression rod 60 against the base of the lever arm 54, pulling the span of the cable 14 taut. Any initial slippage or take-up of sag is allowed for in the movement of the lever 54 which can move backward into a fully perpendicular position before it will contact the switch plunger 64a. Further, the switch 64 mounted in the disc plate 66, is retained against the shoulder of the housing 52 by a ring-lock spring 68 located in a groove in the housing 52. This adjustability by the removal of the lock spring permits the removal of the switch and replacement with another switch, or a switch of a different type, permitting more than one auxiliary function to be performed by the movement of the arm 54 against the switch 64.

It might be pointed out that the actuating arm 54 may be bent to a right-angled configuration, for example, so as to permit the housing 52 to be mounted on a vertical, rather than a horizontal surface, for example, so as to be appropriate to various installation requirements. Specifically, the arm 54 can be a straight arm or a right-angled arm so that the housing 52 may be attached to the side of a roof joist or of a foot and made to operate perpendicular. The two types of arms may be interchangeable.

In the schematic circuit diagrams of FIGS. 4A-4F the wires 24, 25 and 26 of the cable 14 are shown as connected to a master control panel 100 which is capable of responding to various circuit conditions on the cable to activate an alarm 102, for example, at the fire station, an alarm 104, for example, at the police station, and a local alarm such as a light 106 to indicate trouble on the line. An intrusion detector 108 is connected, for example, to the wires 25 and 26. This intrusion detector may be of any known type in which contacts close in the event of an unauthorized intrusion. As in the case of the cable described in the copending application, the wires 24 and 26 are terminated by an appropriate resistor 110 and the wires 25 and 26 are terminated by a resistor 112.

A pre-discharge detector 114 which may, for example, be of the type of spot detector described in the copending application may be connected to the leads 24 and 26 at any location along the cable 14, and this detector serves to detect temperature increases, for example, before the cable itself has been melted so as to connect the wires 24, 25 and 26.

The electric switch 64 may be electrically connected to a suppression device 120, which may be, for example, a sprinkler control located in any selected area of the monitored premises. The suppression device includes its own battery 122 so that it is not dependent upon the power mains. The electric switch 64 which is actuated by the tension arm of FIG. 3 has its first contact connected, for example, to a trouble alarm signal 124, so that an initial relax of tension of the tension arm which causes the first contacts to close merely energizes the trouble alarm 124, and the sprinklers are not activated until the second set of contacts are closed by the switch 64, and there has been a short circuit of the wires 24 and 26 due to a fire condition melting the insulation of the cable 14, so as to complete the circuit for the suppression device 120.

Figure 4A:
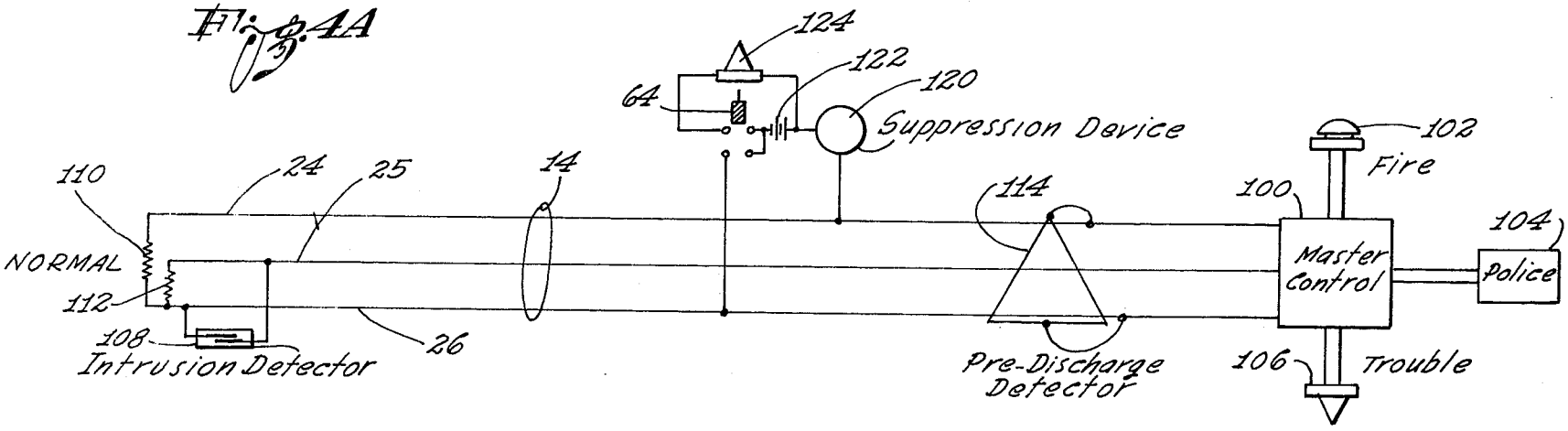
Figure 4B:
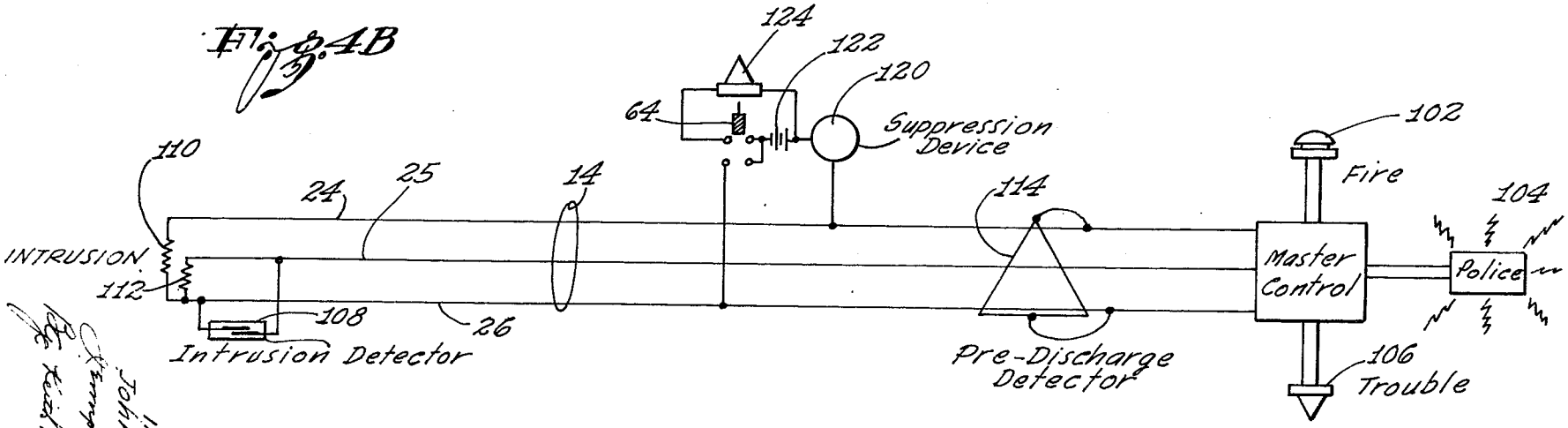

The system under normal operation is shown in FIG. 4A, during which all units are de-energized. Now, should an intruder actuate the detector 108, a connection is established across the wires 25 and 26, and this causes the master control 100 to energize the alarm 104 in the police station, for example, and as shown in FIG. 4B.

Figure 4C:
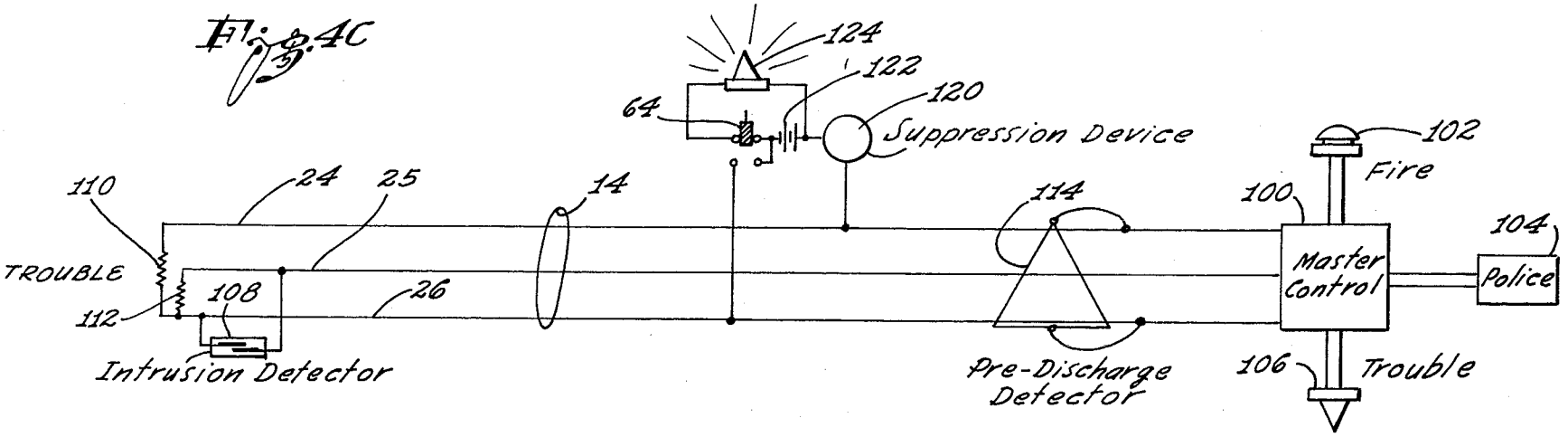

In the event that there is a slackening of the cable 14 for any reason, and which may be a preliminary warning of a fire, or merely a malfunction of the cable, the tension arm of FIG. 3 is relaxed sufficiently to cause the swtich 64 to close its first pair of contacts, as shown in FIG. 4C. Under this condition, the suppression device 120 is not activated, so that the sprinklers are not activated and merely a trouble alarm signal is sounded, as shown by the energization of the trouble alarm 124, so as to permit corrective steps to be taken, if possible, without activating the suppression system.

Figure 4D:
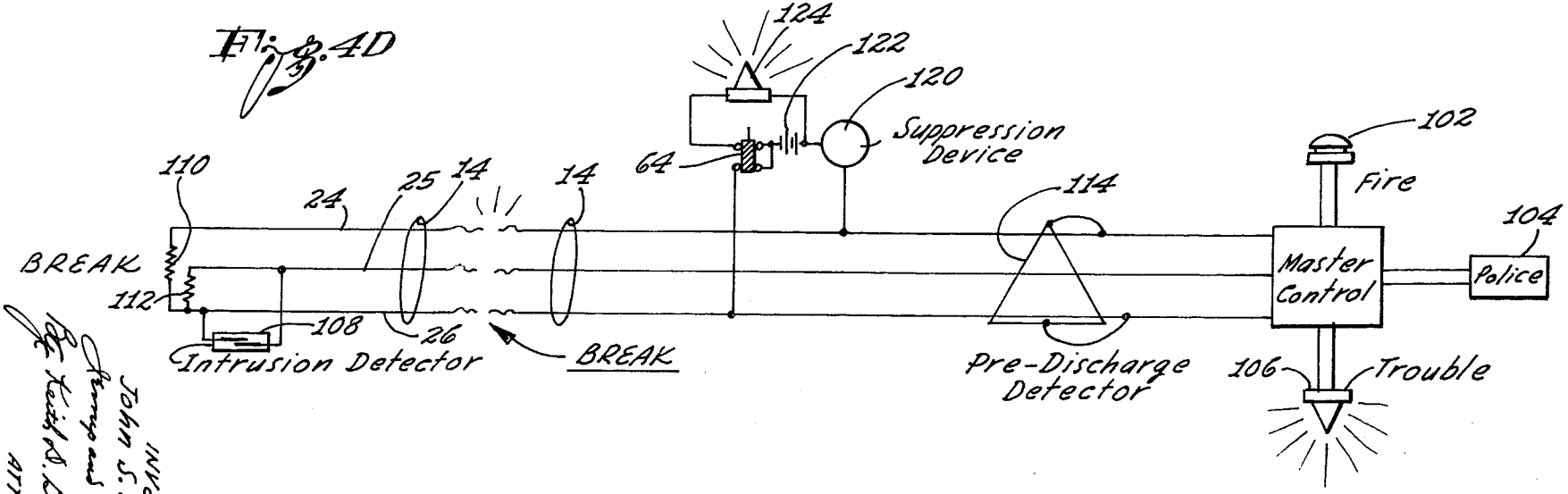

Also, should there be a break in the calbe 14, and even though the tension arm of FIG. 3 is completely relaxed so that the switch 64 activates its second pair of contacts, as shown in FIG. 4D, the suppression device 120 still is not activated since there is no connection established between the wires 24 and 26. However, the trouble alarm 124 sounds to indicate the break, and the trouble light 106 in the master control is activated since there is no completion of circuit through the resistors 110 and 112, which indicates that a break has occurred.

The condition shown in FIG. 4E is one in which a fire has just broken out in the area monitored by the detector 114, and the fire still has not had time to melt the insulation of the cable 14 so as to cause the wires 24, 25 and 26 to interconnect with one another. The activation of the detector 114 causes the master control 100 to energize the fire alarm 102 and also to energize the trouble alarm 106.

In the condition of FIG. 4F, a fire has occurred and has melted the insulation of the cable 14, as shown, so that the wires 24, 25 and 26 spin together and make electrical contact. The resulting relax of tension on the tension arm of FIG. 3 causes the switch 64 to close down to its second contact so that the alarm 124 is energized from the battery 122. Also, the suppression device 120 is energized to activate the sprinklers, since a circuit is not completed between the wires 26 and 24. Also, the master control 100 responds to the short circuit of the cable to activate all the alarms 102, 104 and 106.

The invention provides, therefore, an improved fire and/or intrusion control system which is advantageous since it may respond to a wide variety of conditions in a simple and straight-forward manner. The system of the invention is also advantageous in that it is capable of detecting trouble on the cable or a break of the cable, and also in that its operation is not impeded by a failure of the electric power main.

It will be appreciated that although a particular embodiment of the invention has been shown and described, modifications may be made. It is intended, therefore, to cover all such modifications as fall within the spirit and scope of the invention in the following claims.

What is claimed is:

1. An electrical control system including: an elongated twisted heat-sensing cable comprising a plurality of electric wires and temperature-sensitive insulating material normally holding said wires separated and insulated from one another; first and second spaced support members; means for mounting said twisted heat-sensing cable under tension between said first and second support members so as to cause said electric wires to contact one another upon the reaction of said insulating material to temperatures above a particular threshold; a spring-biased actuating member included in said mounting means; and an electric switch connected in circuit with the wires in said twisted heat-sensing cable and mounted adjacent said actuating member to be operated thereby upon a loss of tension in said cable.

2. The combination defined in claim 1, in which said electric switch includes a first pair of contacts which are closed when said loss in tension is less than a predetermined value, and a second pair of contacts which are closed when said loss of tension exceeds said predetermined value.

3. The combination defined in claim 1, and which includes an electrically energized fire suppression device, an electrically energized alarm device, an electric circuit for supplying power to said suppression device and to said alarm device, said electric circuit being connected to the aforesaid switch so as to activate the aforesaid alarm device upon operation of said switch, and said circuit being connected to two of the aforesaid wires in said cable so as to activate said fire suppression device only upon the operation of said switch and upon the contacting of the wires in said cable with one another.

4. The combination defined in claim 1, and which includes an intrusion detector connected to the wires in said cable, and including means for establishing a connection across the aforesaid wires in the event of an unauthorized intrusion into the premises monitored by the control system.

5. The combination defined in claim 2, in which said cable includes at least two separate electric wires, and which includes an electrically energized fire suppression device, an electrically energized trouble alarm signal device, and energizing circuitry connected to said suppression device and to said alarm signal device, said energizing circuitry being connected to said switch so as to complete a circuit to said trouble alarm signal device when said switch is in position to close said first pair of contacts, and to complete a circuit to said suppression device only when said switch is in position to close said second pair of contacts, and the electric wires in said cable have contacted one another.

6. The combination defined in claim 1, in which said switch includes a pair of contacts which are activated when a loss in tension occurs in said cable, and which indicates an electrically energized trouble alarm signal device, and energizing circuitry connected to said trouble alarm signal device and to said switch so as to complete a circuit to said trouble alarm signal device when said switch is in position to activate said contacts.

* * * * *